US006752054B2

(12) United States Patent
Knight

(10) Patent No.: US 6,752,054 B2
(45) Date of Patent: Jun. 22, 2004

(54) UTILITY CUTTING TOOL HAVING TOGGLE LINK MECHANISM FIELD OF THE INVENTION

(75) Inventor: John Benjamin Knight, Plymouth, NE (US)

(73) Assignee: Irwin Industrial Tool Company, Freeport, IL (US)

( * ) Notice: Subject to any disclaimer, the term of this patent is extended or adjusted under 35 U.S.C. 154(b) by 213 days.

(21) Appl. No.: 09/754,039

(22) Filed: Dec. 28, 2000

(65) Prior Publication Data

US 2002/0083809 A1 Jul. 4, 2002

(51) Int. Cl.[7] ..... B26B 13/00
(52) U.S. Cl. ..... 83/13; 30/251; 30/341
(58) Field of Search ..... 30/251, 257, 259, 30/341; D8/57

(56) References Cited

U.S. PATENT DOCUMENTS

| | | | | | |
|---|---|---|---|---|---|
| 21,369 | A | | 8/1858 | Roome | |
| 92,202 | A | | 7/1869 | McFarlane | |
| 94,514 | A | | 9/1869 | Richard | |
| 106,253 | A | | 8/1870 | Bullard et al. | |
| 115,415 | A | * | 5/1871 | Barling | 30/251 |
| 133,220 | A | | 11/1872 | Gilbert | |
| 140,388 | A | * | 7/1873 | Rogers | 30/251 |
| 146,942 | A | * | 1/1874 | Nunan | 30/251 |
| 159,598 | A | | 2/1875 | MeGee | |
| 160,563 | A | * | 3/1875 | Billings | 30/251 |
| 165,445 | A | * | 7/1875 | Graham | 30/251 |
| 180,410 | A | | 8/1876 | Austin | |
| 192,426 | A | | 6/1877 | Foltz et al. | |
| 291,623 | A | | 1/1884 | Plumb | |
| 391,859 | A | | 10/1888 | Reinert | |
| 417,790 | A | | 12/1889 | Postle | |
| 476,459 | A | | 6/1892 | Hamann et al. | |
| 509,125 | A | | 11/1893 | Hamann | |
| 547,264 | A | * | 10/1895 | Jennings | 30/257 |
| 563,458 | A | | 7/1896 | Dillenbach | |

(List continued on next page.)

FOREIGN PATENT DOCUMENTS

| | | |
|---|---|---|
| EP | 0 792 727 A1 | 9/1997 |
| FR | 491670 | 6/1919 |
| GB | 181669 | 8/1921 |

OTHER PUBLICATIONS

Hancock Tools Catalog No. 50, "Specialty Tools for the Garden Shop and Home", date unknown but prior to Dec. 18, 2000, 8 pages.

Dixon Tools Catalog, "Art Metal Crafts Tools and Supplies", date unknown but prior to Dec. 18, 2000, 4 pages.

The General Tool Company Catalog No. 42, date unknown but prior to Dec. 18, 2000, pp 59–61.

(List continued on next page.)

*Primary Examiner*—Allan N. Shoap
*Assistant Examiner*—Jason Prone
(74) *Attorney, Agent, or Firm*—Brinks Hofer Gilson & Lione

(57) ABSTRACT

A utility tool utilizing a toggle link mechanism and a method for using the utility tool for providing a substantial mechanical advantage for a user throughout an entire work operation such as cutting sheet material. The tool comprises an upper handle, a jaw pivotally attached to the upper handle and a jaw link rigidly attached to the jaw. The tool further comprises a means for inputting force connected with the upper handle and a handle link rigidly attached to the handle. The tool also comprises a toggle action force transfer mechanism defined by an intermediary link extending between the jaw link and handle link, wherein force inputted to the means moves the intermediary link away from the upper handle.

13 Claims, 5 Drawing Sheets

U.S. PATENT DOCUMENTS

| | | | | | |
|---|---|---|---|---|---|
| 607,388 | A | | 7/1898 | Whitacre | |
| 608,491 | A | | 8/1898 | Thompson | |
| 625,896 | A | | 5/1899 | O'Dell | |
| 641,966 | A | | 1/1900 | Howe | |
| 644,350 | A | | 2/1900 | Decelle | |
| 689,846 | A | * | 12/1901 | Beauchemin | 30/251 |
| 756,818 | A | | 4/1904 | Benton | |
| 793,200 | A | | 6/1905 | Knight | |
| 804,426 | A | | 11/1905 | Mullen | |
| 835,900 | A | | 11/1906 | Casterlin | |
| 873,333 | A | | 12/1907 | Sweet | |
| 884,410 | A | | 4/1908 | Nicholson et al. | |
| 896,088 | A | | 8/1908 | De Celle | |
| 936,574 | A | | 10/1909 | Searight | |
| 942,043 | A | | 11/1909 | Searight | |
| 955,287 | A | | 4/1910 | Schofield | |
| 1,013,889 | A | | 1/1912 | Newman | |
| 1,046,852 | A | | 12/1912 | Prince | |
| 1,164,981 | A | | 12/1915 | Bernard | |
| 1,210,128 | A | | 12/1916 | Woolf | |
| 1,243,540 | A | | 10/1917 | Miller | |
| 1,254,284 | A | | 1/1918 | Southwood | |
| 1,267,663 | A | | 5/1918 | Hendershot | |
| 1,299,100 | A | | 4/1919 | Anderson | |
| 1,304,917 | A | | 5/1919 | Stauffer | |
| 1,321,745 | A | | 11/1919 | Howard | |
| 1,330,515 | A | * | 2/1920 | Bryant | 30/257 |
| 1,356,882 | A | | 10/1920 | Pendelton | |
| 1,401,546 | A | | 12/1921 | Mae | |
| 1,425,744 | A | | 8/1922 | Bratschie | |
| 1,425,779 | A | | 8/1922 | Killin | |
| 1,432,241 | A | | 10/1922 | Goodwin | |
| 1,436,603 | A | * | 11/1922 | Philbert | 30/251 |
| 1,446,540 | A | | 2/1923 | Bernard | |
| 1,469,072 | A | * | 9/1923 | Dodson | 30/251 |
| 1,490,077 | A | | 4/1924 | Jessee | |
| 1,507,529 | A | | 9/1924 | Sundman | |
| 1,524,723 | A | | 2/1925 | Wagenbach | |
| 1,572,546 | A | | 2/1926 | McKenney | |
| 1,572,787 | A | | 2/1926 | Glee et al. | |
| 1,585,572 | A | | 5/1926 | Takacs | |
| 1,594,671 | A | * | 8/1926 | Isaac | 30/259 |
| 1,607,470 | A | | 11/1926 | McKenney | |
| 1,612,606 | A | | 12/1926 | Carlson | |
| 1,634,848 | A | | 7/1927 | Perrakis | |
| 1,639,677 | A | | 8/1927 | Vaughan | |
| 1,648,984 | A | | 11/1927 | Enell | |
| 1,700,306 | A | | 1/1929 | Bernard | |
| 1,704,313 | A | | 3/1929 | Daniel | |
| 1,741,971 | A | | 12/1929 | Bodendieck | |
| 1,836,967 | A | | 12/1931 | Helwig | |
| 1,862,033 | A | | 6/1932 | Porter | |
| 1,909,846 | A | | 5/1933 | Porter | |
| 1,931,045 | A | | 10/1933 | Vosbikian et al. | |
| 1,931,569 | A | | 10/1933 | Brown | |
| 1,943,960 | A | | 1/1934 | Heumann | |
| 1,962,636 | A | | 6/1934 | Clark | |
| 2,005,694 | A | | 6/1935 | Vosbikian et al. | |
| 2,073,460 | A | | 3/1937 | Vosbikian et al. | |
| 2,074,239 | A | | 3/1937 | Rush | |
| 2,090,228 | A | | 8/1937 | Porter et al. | |
| 2,179,732 | A | | 11/1939 | Scanlon | |
| 2,207,222 | A | * | 7/1940 | McGary | 30/251 |
| 2,207,223 | A | * | 7/1940 | McGary | 30/251 |
| 2,277,442 | A | * | 3/1942 | Kuhlman | 30/251 |
| 2,284,536 | A | * | 5/1942 | Parker | 30/257 |
| 2,287,303 | A | | 6/1942 | Habart et al. | |
| 2,292,271 | A | | 8/1942 | Heise | |
| 2,295,385 | A | | 9/1942 | Connors | |
| 2,311,695 | A | | 2/1943 | Romanoff | |
| 2,356,672 | A | | 8/1944 | Ivy | |
| 2,375,364 | A | * | 5/1945 | Hood | 30/251 |
| 2,406,670 | A | | 8/1946 | Delgado | |
| 2,436,260 | A | | 2/1948 | Klenk | |
| 2,437,432 | A | | 3/1948 | Martines | |
| 2,442,424 | A | | 6/1948 | McGary et al. | |
| 2,449,561 | A | * | 9/1948 | McGary et al. | 30/251 |
| 2,455,009 | A | | 11/1948 | Hood | |
| 2,469,036 | A | | 5/1949 | Hart | |
| 2,476,895 | A | | 7/1949 | Muter | |
| 2,505,502 | A | | 4/1950 | Moberg | |
| 2,520,905 | A | | 9/1950 | Borrelli | |
| 2,523,610 | A | | 9/1950 | Caddy | |
| 2,527,735 | A | | 10/1950 | Johnson | |
| 2,528,815 | A | | 11/1950 | Boyer | |
| 2,528,816 | A | * | 11/1950 | Boyer | 30/251 |
| 2,539,294 | A | | 1/1951 | Barnes | |
| 2,542,125 | A | | 2/1951 | Evans | |
| 2,546,073 | A | | 3/1951 | Kosik | |
| 2,558,697 | A | | 6/1951 | Vosbikian et al. | |
| 2,575,630 | A | | 11/1951 | Klenk | |
| 2,579,272 | A | | 12/1951 | Ralston | |
| 2,587,586 | A | | 3/1952 | Bernardi | |
| 2,655,722 | A | | 10/1953 | Klenk | |
| 2,660,783 | A | | 12/1953 | Davis et al. | |
| 2,690,010 | A | | 9/1954 | Keller | |
| 2,715,270 | A | | 8/1955 | Oxhandler | |
| 2,745,178 | A | | 5/1956 | Rogoff | |
| 2,749,615 | A | | 6/1956 | Griffon | |
| 2,766,526 | A | | 10/1956 | Pape | |
| 2,773,307 | A | | 12/1956 | Martin | |
| 2,803,058 | A | | 8/1957 | Mead | |
| 2,806,394 | A | | 9/1957 | Briegel | |
| 2,869,235 | A | | 1/1959 | Klenk | |
| 2,908,076 | A | | 10/1959 | Veith et al. | |
| 2,937,441 | A | * | 5/1960 | Reese | 30/251 |
| 3,007,245 | A | | 11/1961 | Keiser, Jr. | |
| 3,026,613 | A | | 3/1962 | Nelson | |
| 3,090,121 | A | * | 5/1963 | Chonka | 30/251 |
| 3,159,913 | A | | 12/1964 | Winton | |
| 3,170,345 | A | | 2/1965 | Poingt | |
| 3,182,485 | A | | 5/1965 | Sund | |
| 3,187,430 | A | | 6/1965 | Wallace et al. | |
| 3,196,540 | A | | 7/1965 | Porzky | |
| 3,324,549 | A | | 6/1967 | Sharp | |
| 3,339,280 | A | * | 9/1967 | Hall | 30/251 |
| 3,372,478 | A | | 3/1968 | Wallace et al. | |
| 3,422,532 | A | | 1/1969 | Ballard | |
| 3,596,355 | A | | 8/1971 | Wertspay, Sr. | |
| 3,636,954 | A | | 1/1972 | Weston | |
| 3,638,307 | A | | 2/1972 | Stewart | |
| 3,681,845 | A | | 8/1972 | Duprey | |
| 3,838,508 | A | | 10/1974 | Turner, Sr. | |
| 3,851,389 | A | | 12/1974 | Swanson | |
| 3,885,309 | A | | 5/1975 | Lund et al. | |
| 4,079,513 | A | | 3/1978 | Harrison | |
| 4,094,064 | A | | 6/1978 | Nishikawa et al. | |
| 4,146,961 | A | | 4/1979 | Pinto | |
| 4,184,249 | A | | 1/1980 | Megna et al. | |
| 4,254,551 | A | | 3/1981 | Megna et al. | |
| RE30,613 | E | | 5/1981 | Nakamura et al. | |
| 4,283,805 | A | | 8/1981 | Stacy | |
| 4,336,652 | A | | 6/1982 | Robertson | |
| 4,341,016 | A | | 7/1982 | Harrison et al. | |
| 4,438,565 | A | | 3/1984 | Hough | |
| 4,463,497 | A | | 8/1984 | O'Keeffe | |
| 4,502,222 | A | | 3/1985 | Sargent | |
| 4,525,929 | A | * | 7/1985 | Brophy et al. | 30/251 |
| 4,569,132 | A | | 2/1986 | Hill | |
| 4,635,363 | A | | 1/1987 | Chapin | |
| 4,644,652 | A | | 2/1987 | Davis | |

| | | | | | |
|---|---|---|---|---|---|
| 4,648,145 | A | | 3/1987 | Miceli | |
| 4,753,011 | A | * | 6/1988 | Long | 30/257 |
| 4,759,127 | A | | 7/1988 | Gingher, Jr. | |
| 4,894,913 | A | | 1/1990 | Ladin | |
| 4,967,475 | A | * | 11/1990 | O'Keeffe et al. | 30/259 |
| 5,003,695 | A | | 4/1991 | Lipscomb et al. | |
| 5,014,433 | A | | 5/1991 | Tepic | |
| 5,020,222 | A | | 6/1991 | Gosselin et al. | |
| 5,029,355 | A | | 7/1991 | Thai | |
| 5,058,277 | A | | 10/1991 | Kishimoto | |
| 5,060,382 | A | | 10/1991 | Wilhelm et al. | |
| 5,074,046 | A | * | 12/1991 | Kolesky | 30/259 |
| 5,159,757 | A | * | 11/1992 | Weid et al. | 30/251 |
| 5,226,237 | A | | 7/1993 | Rancour et al. | |
| 5,267,400 | A | | 12/1993 | Danube et al. | |
| 5,459,929 | A | | 10/1995 | Linden et al. | |
| 5,469,625 | A | | 11/1995 | Melter et al. | |
| 5,503,049 | A | | 4/1996 | Chervenak et al. | |
| 5,551,157 | A | | 9/1996 | Wu | |
| 5,625,951 | A | | 5/1997 | Hamlin | |
| 5,689,886 | A | | 11/1997 | Yeh | |
| 5,694,694 | A | | 12/1997 | Roskam | |
| 5,699,617 | A | | 12/1997 | Mock | |
| 5,761,815 | A | * | 6/1998 | Lin | 30/251 |
| 6,000,307 | A | | 12/1999 | Aamodt | |
| 6,308,421 | B1 | | 10/2001 | Wang | |
| 6,513,248 | B2 | * | 2/2003 | Linden et al. | 30/251 |

OTHER PUBLICATIONS

The Strong Carlisle & Hammond Co. Catalogue E, "Factory and Mill Supplies", date unknown but prior to Dec. 18, 2000, pp 455–456.

Bartlett Mfg. Co., listing for Tinners Snips, Thomas Register, 1936, 1 page.

Hancock Tool Mfg. Co, listing for Tinners Snips, Thomas Register, 1938, 1 page.

Bartlett Mfg. Co., listing for Tinners' Snips, Thomas Register, 1941, 1 page.

Bremil Mfg. Co., listing for All Alloy Portable Shears, Thomas Register, 1942, 1 page.

Bartlett Mfg. Co., listing for Snips, Thomas Register, 1945, 1 page.

Bartlett Mfg. Co., listing for Shears, Thomas Register, 1951, 1 page.

Bremil Mfg. Co., listing for Compound Lever Shears, Thomas Register, 1951, 1 page.

Whitney–Jensen, listing for No. 2 Shear, Thomas Register, 1954, 1 page.

Bartlett Mfg. Co., listing for Compound Lever Shears, Thomas Register, 1955, 1 page.

Diamond Tool & Horseshoe Co., listing for Diamalloy Aviation Snips, Thomas Register, 1965, 1 page.

Diamond Tool & Horseshoe Co., listing for Diamalloy Aviation Snips, Thomas Register, 1966, 1 page.

Karl Klenk Inc., listing for Cam Action Snips, Thomas Register, 1967, 1 page.

Karl Klenk Inc., listing for Cam Action Snips, Thomas Register, 1973, 1 page.

Clauss Cutlery, Co., listing for Snips, Thomas Register, 1979, 1 page.

Karl Klenk Inc., listing for Aviation Snips; Diamond Tool and Horseshoe Co., listing for Aviation Snips and Clauss Cutlery Co., listing for Snips, Thomas Register, 1984, 1 page.

Clauss Tools, lisitng for "Sure Edge" Snips, and Diamond Tool and Horseshoe Co., listing for Aviation Snips, Thomas Register, 1986, 1 page.

American Tool Companies, Inc., listing for "Prosnip" Aviation, Offset and Tinner Snips, Thomas Register, 1989, 1 page.

Klenk Industries, Inc. listing for Snips; American Tool Companies, Inc. listing for "Prosnip" Aviation, Offset and Tinner Snips, and Regis Industrial Supply, listing for Industrial Snips, Thomas Register, 1989, 1 page.

Karl Klenk, Inc., advertisement for Aviation snips, SNIPS, vol. 22, No. 9, 1953, 2 pages.

Hancock Tool Co., advertisement for Tinner Snips, date unknown but prior to Dec. 28, 2000, 1 page.

Karl Klenk, Inc., advertisement for "Double Cam Action Aviation Snips", 1952, 1 page.

Karl Klenk, Inc., copy of a picture of Klenk Snips, date unknown but believed to be between 1950–52, 1 page.

Karl Klenk, Inc., advertisement for Snips, Nov., 1953, 1 page.

Bernard brochure for Aviation and Tinners Snips, date unknown but believed to be prior to 1948, 4 pages.

Bartlett advertisement for Compound Lever Shears, Hardware Age—Merchandise Directory, 1961, p. 445.

Crescent Tools advertisement for tools, Hardware Age—Merchandise Directory, 1961, p. 93.

J. Wiss & Sons, Inc. advertisement for Shears and Snips, Hardware Age—Merchandise Directory, 1961, p. 437.

Bartlett Shears advertisement for Shears, Hardware Age—Merchandise Directory, dated prior to 1974, p. 304.

Diamond Tool advertisement, Hardware Retailing, date unknown but believed to be 1960, pp 302–303.

Karl Klenk, Inc., advertisement for Double Cam Action Aviation Snips and Shears, Hardware Retailing, 1957, 1 page.

Karl Klenk, Inc., advertisement for Double Cam Action Aviation Snips and Shears, Hardware Retailing, 1958, 1 page.

Karl Klenk, Inc., picture of cutting tool, date unknown but prior to Dec. 18, 2000, 1 page.

Hancock Tool Manufacturing Co., picture of cutting tool, date unknown but prior to Dec. 18, 2000, 1 page.

American Tool Companies, Inc., picture of a cutting tool, date unknown but prior to Dec. 18, 2000, 1 page.

* cited by examiner

UTILITY CUTTING TOOL HAVING TOGGLE LINK MECHANISM FIELD OF THE INVENTION

FIELD OF THE INVENTION

The present invention relates generally to cutting tools. In particular, the present invention relates to improved snips having a toggle link mechanism.

Various kinds of cutting tools have been designed which provide a leveraged mechanical advantage to a user during a cutting cycle. This mechanical advantage allows a user to cut hardened materials such as sheet metal by hand. In the tools of the prior art, however, the various mechanical linkages provide that a substantial amount of the mechanical advantage is lost toward the tips of the blades of the cutting tools as the blades converge during the cutting operation. This loss of mechanical advantage requires the user to apply a greater amount of force to complete a cut throughout the full length of the cutting stroke. The cutting operation is thus less efficient and more demanding on the user.

The prior art has further shortcomings. In particular, the cutting handle may not be elevated over the material being cut during the cutting operation, thereby further hindering the user. While it is common to provide scissor handles that are attached to the cutting blades in an offset fashion, such an arrangement makes the scissors awkward to use. Furthermore, the offset location of the handles from the blades causes the user to lose additional mechanical advantage, as the hand may not be efficiently positioned to deliver force relative to the tool.

BRIEF SUMMARY OF THE INVENTION

It is a general object of the invention to provide a new and useful cutting tool for cutting, among other materials, sheet metal by hand which provides a substantial mechanical advantage for the user throughout the entire cutting operation. Another object that the present invention provides is a new and useful method of cutting sheet metal, and other materials, by using the cutting tool described herein.

One aspect of the present invention integrates a toggle link mechanism into an improved cutting tool. This toggle mechanism provides a mechanical advantage to the user throughout the entire cutting operation to facilitate cutting. This configuration also simplifies manufacture and improves the durability of the tool.

In yet another aspect of the invention, an elevated handle is also provided so that during the cutting operation, the user's hand is raised from the cutting surface and free of the material being cut. When the cutting blade of the upper jaw section is substantially aligned with the horizontal plane and the cutting tool is in the closed position, the upper and lower handles are elevated from the upper jaw section.

In yet another aspect of the present invention, curved blades are provided which curve away from the material being cut during the cutting process. The curved blades further assist the user in maximizing cutting efficiency throughout the cutting cycle.

One embodiment of the claimed invention includes an upper handle having an upper jaw section, a gripping section suitable for being grasped and an intermediary section connecting the upper jaw section with the gripping section. The upper jaw section defines a blade portion and the upper jaw section is forward of the gripping section. The cutting tool further comprises a lower handle having a gripping section wherein the lower handle is pivotally attached to the upper handle at a handle pivot point. The lower handle may be pivoted toward the gripping section of the upper handle from an open position to a closed position. The lower handle also has a first link pivot point which is forward of the handle pivot point. The cutting tool further comprises a lower jaw pivotally attached to the upper jaw section of the upper handle at a jaw pivot point. The lower jaw also has a second link pivot point rearward of the jaw pivot point. The lower jaw also has a blade portion. The cutting tool further comprises a link pivotally attached to the lower handle at the first link pivot point. The link is pivotally attached to the lower jaw at the second link pivot point such that pulling the lower handle toward the gripping section of the upper handle moves the link. The link then causes the blade portion of the lower jaw to pivot toward the blade portion of the upper handle. The handle pivot point, the first link pivot point and the second link pivot point form a substantially straight line when the lower handle is in the closed position.

In accordance with another aspect of the invention, a second embodiment of the cutting tool is provided wherein the tool comprises an upper handle for holding the tool and a jaw pivotally connected with the handle and including a jaw link rigidly attached to the jaw. A means is also provided for inputting force connected with the upper handle and including a handle link rigidly attached to the handle. The utility tool further comprises a toggle action force transfer mechanism defined by an intermediary link extending between the jaw link and the handle link. Force inputted to the input means moves the intermediary link away from the upper handle.

The innovation may also be embodied in a method wherein a user employs a cutting tool with toggle link mechanism. The mechanism comprises the steps of providing a cutting tool comprising an upper handle, a lower handle, a link and a lower jaw. The upper handle is pivotally connected with the lower handle at a handle pivot point. The link is connected with the lower handle at a first link pivot point and is connected with the lower jaw at a second link pivot point. The lower jaw is pivotally connected with the upper handle and the lower jaw and upper handle define two blades. The steps of the method also provide for sheet material. The sheet material is placed in between the blades of the cutting tool when the cutting tool is in the open position. Force is applied to the lower handle by rotating the lower handle around the handle pivot point. The link moves in a downward direction as the lower handle is rotated so that the first link pivot point, the second link pivot point and the handle pivot point approach a substantially straight line. The lower jaw pivots so that the lower blade moves toward the upper blade, cutting the sheet material.

DETAILED DESCRIPTION OF THE PREFERRED EMBODIMENTS OF THE INVENTION

Figure 1:
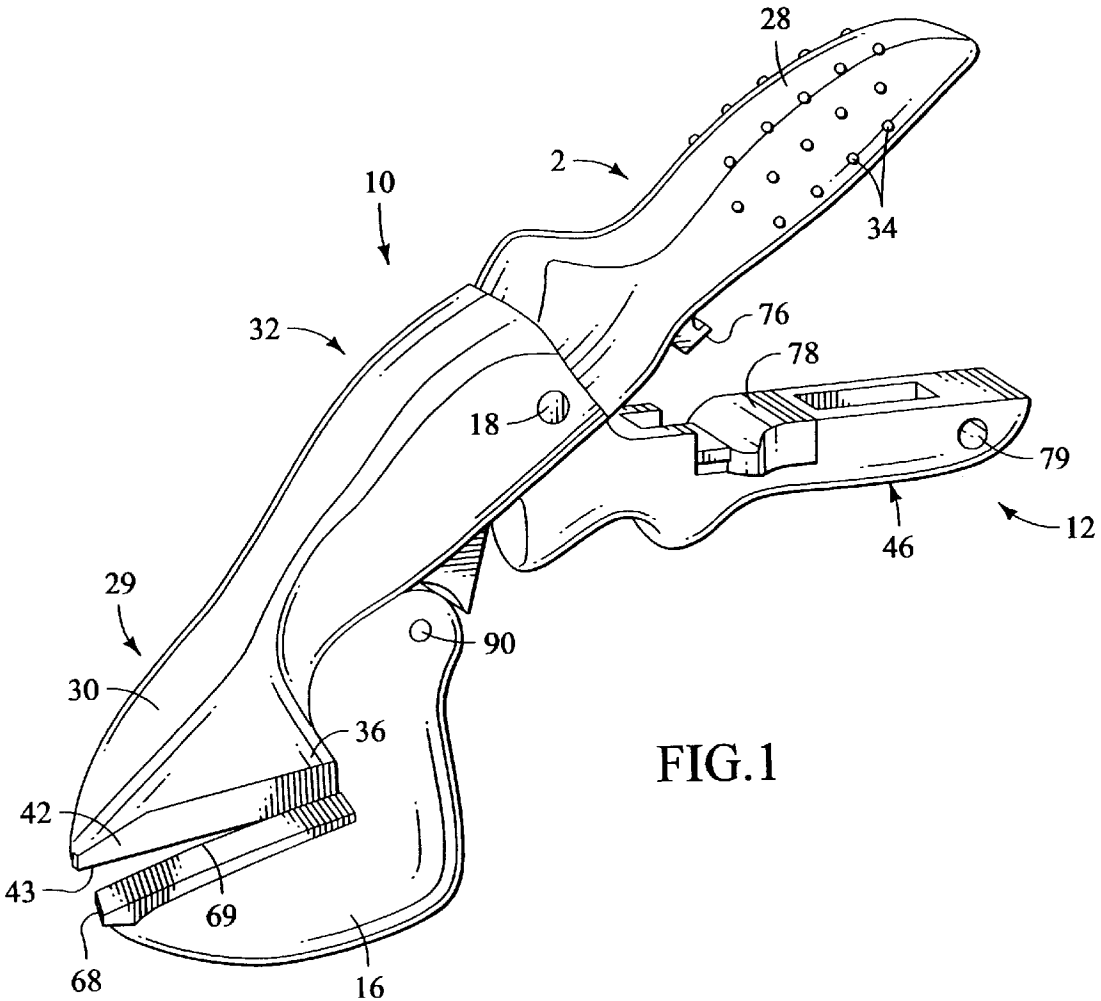
FIG. 1 is a perspective view of the cutting tool of the present invention showing the tool between the fully open and fully closed position.
Figure 2:
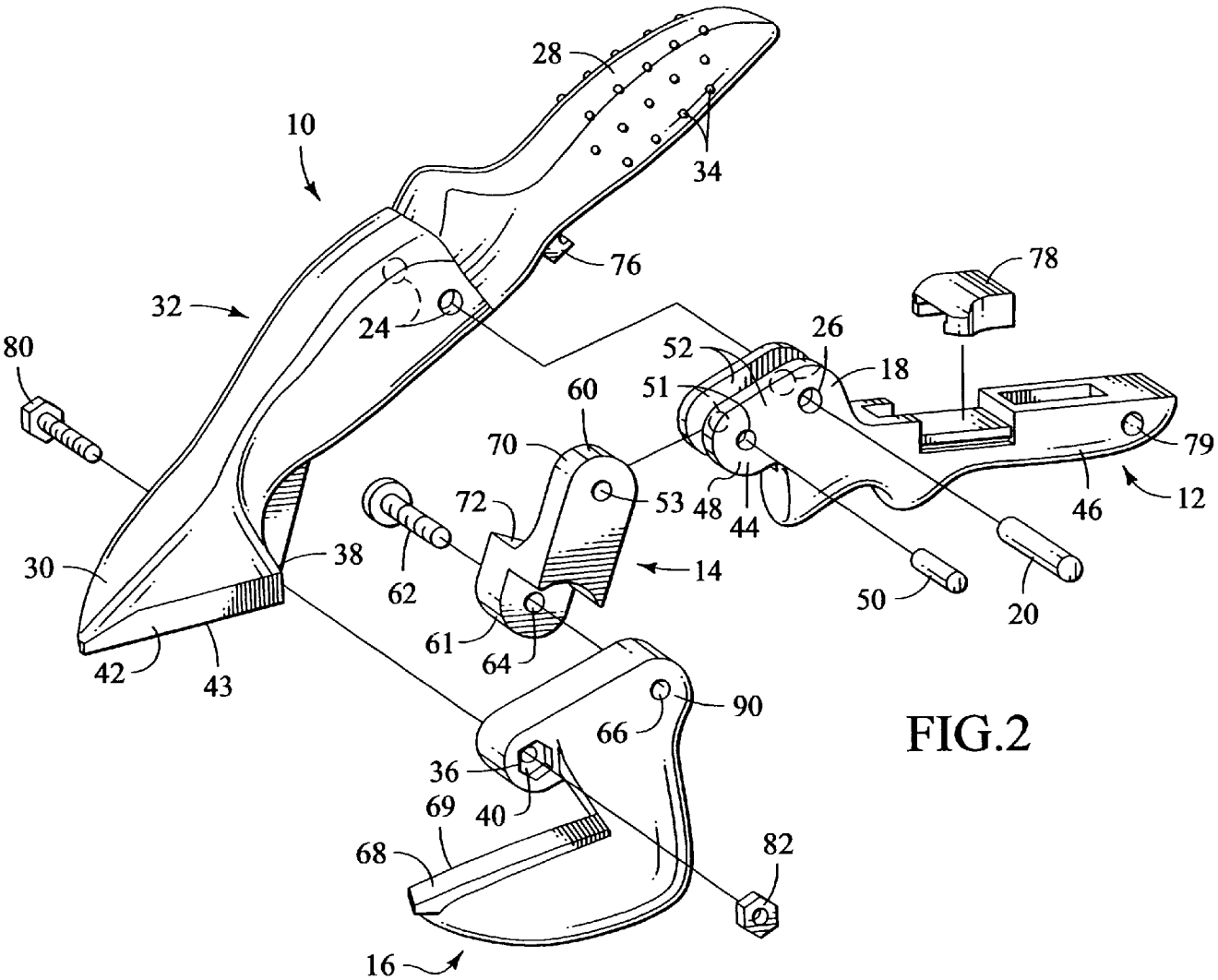
FIG. 2 is a perspective exploded view of the cutting tool of FIG. 1.

The FIGS. 1 through 8 shows a first embodiment of a cutting tool 2 for cutting sheet material by hand. FIG. 2 shows the cutting tool 2 in an exploded view, in particular depicting how each of the parts of the preferred embodiment connects with each other. The cutting tool preferably comprises an upper handle 10, a lower handle 12, a lower jaw 16 and an intermediary link 14. The upper handle 10 is pivotally connected to the lower handle 12 at a handle pivot point 18 preferably using a pin 20. A dowel or screw may also be used in this connection or in any of the connections described herein.

Figure 3:
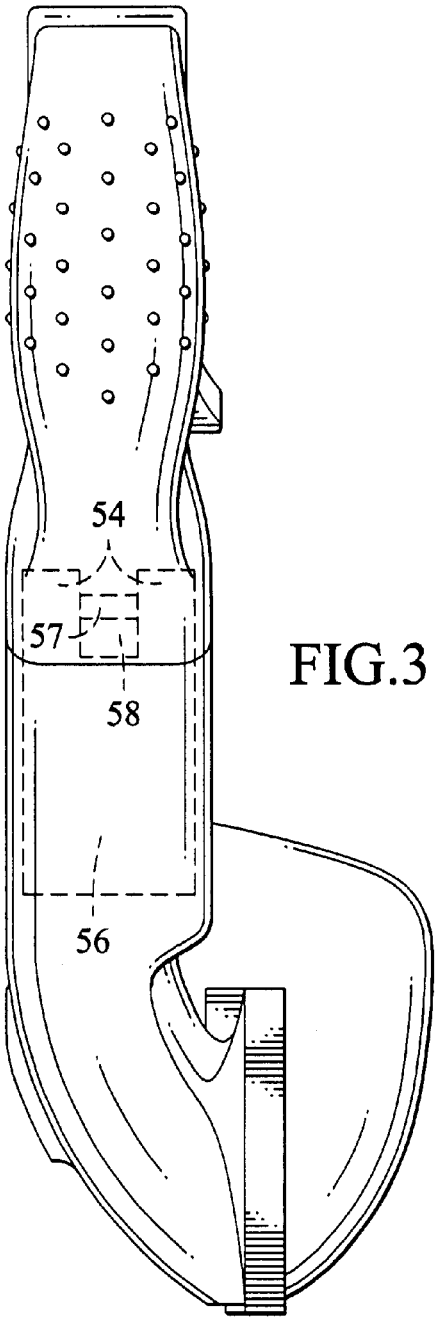
FIG. 3 is a top view of the cutting tool shown in the above Figures.

Preferably, as shown in FIG. 2 and FIG. 3, the pin 20 passes through the holes 24 defined in the upper handle 10, a hole 57 defined in the center connecting member 58 of the upper handle 10, and the holes 26 of the lower handle 12. At this pivotal connection, and at the other pivotal connections of the invention, a bridge type connection or an offset type connection may be used interchangeably. FIG. 2 depicts a bridge-type connection wherein the pin 20 passes through the lower handle 12 and the lower handle 12 is restrained on two opposing surfaces by the upper handle 10. FIG. 2, also depicts an example of an offset type connection, as shown by the pivotal connection between the lower jaw 16 and the intermediary link 14 at pivot point 90 wherein the intermediary link 14 is restrained on only one surface by the lower jaw 16. Overlapping pivotal connections without offset may also be used.

The lower jaw 16 is also pivotally connected to the upper handle 10 at a jaw pivot point 36 preferably using a screw 80 and a nut 82. The screw 80 passes through a hole 38 defined in the upper handle 10 and through a hole 40 of the lower jaw 16.

The upper handle 10 preferably defines a gripping section 28, an upper jaw section 30 and an intermediary section 32. The gripping section 28 allows a user to handle the cutting tool 2. The gripping section 28 may be contoured to minimize slippage from the user's hand and may contain other ergonomic features for user comfort. The gripping section 28 is preferably coated with an elastomer which contains anti-slipping properties and which provides a soft feel. The gripping section 28 may also be textured with dimples 34 to further provide gripping properties. The gripping section 28 may also define a loop or arch (not shown) similar to those found on the handles of scissors. This loop or arch preferably includes a distal connection with the gripping section 28. The loop or arch should be suitably sized to fit a users thumb, fingers or hand when the user is grasping the cutting tool 2 and should be operative to aid in opening the cutting tool's handles 10, 12 as the user opens his or her hand after successive cutting cycles.

The upper handle 10 preferably also includes an upper jaw section 30 located forwardly of the gripping section 28 on the forward end 29 of the upper handle 10. This upper jaw section 30 includes a blade 42 preferably having a sharp edge 43 for contacting and cutting the sheet material. The blade 42 can be defined or machined into the upper jaw section 30, or the blade 42 can be a separate removable element to allow the user to conveniently replace the blade 42 as necessary. An intermediary section 32 extends between the upper jaw section 30 and the gripping section 28.

The lower handle 12 preferably comprises a proximal gripping section 46 and a distal handle link section 48 located forwardly of the gripping section 46. At the handle link section 48, the lower handle 12 is pivotally connected to the upper handle 10 at a handle pivot point 18 by a pin 20. At the handle link section 48, the lower handle 12 is also pivotally connected to the intermediary link 14 at a first link pivot point 44 by the pin 50. A dowel or screw may also be used in this connection. The pin 50 passes through the holes 51 of the lower handle 12 and the hole 53 of the intermediary link 14. The distal handle link section 48 defines a handle link 47 extending between points 18 and 44 thereon. The first link pivot point 44 is located forwardly of the handle pivot point 18 on the handle link section 48.

Figure 4:
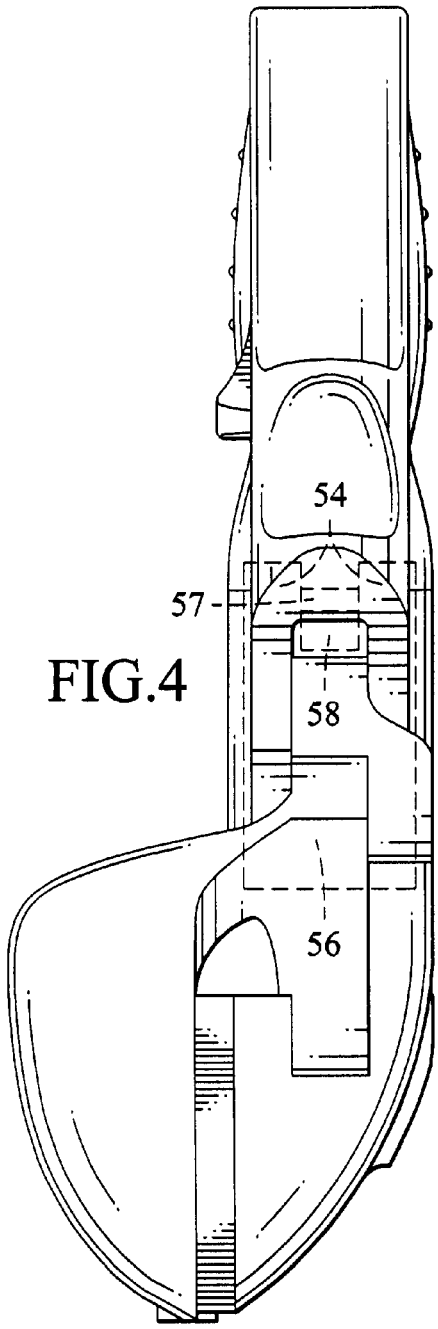
FIG. 4 is a bottom view of the cutting tool shown in the above Figures.
Figure 5:
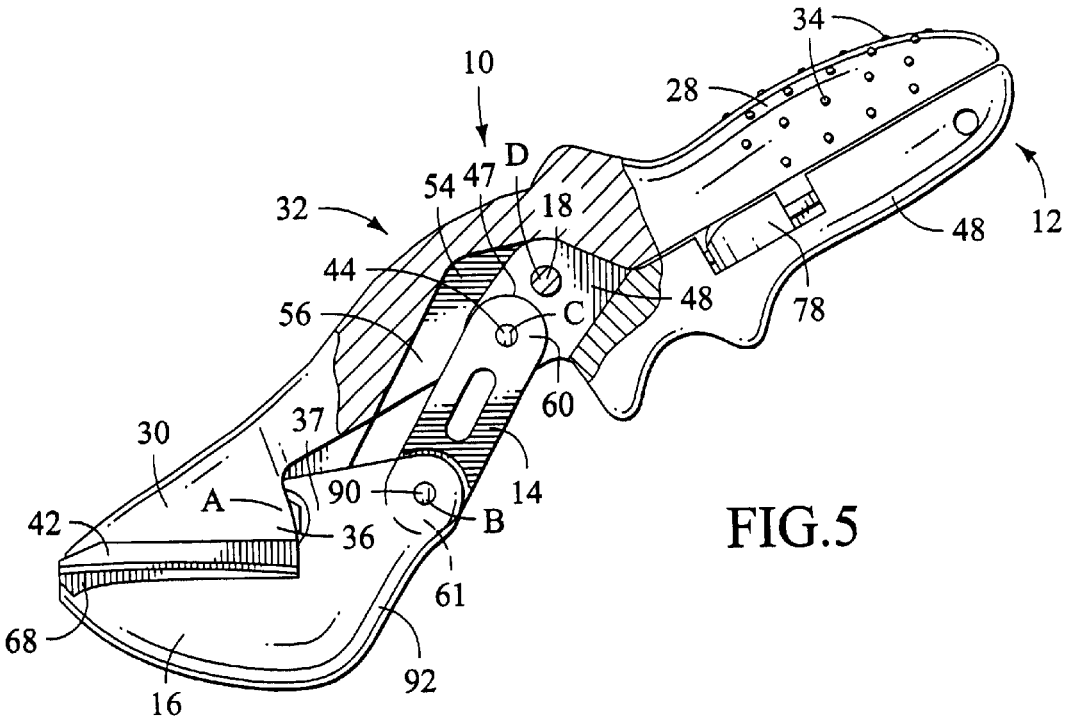
FIG. 5 is a partially cut-away side view of the cutting tool of the above Figures in the closed position.

At the distal handle link section 48, the lower handle 12 forms two parallel fins 52 spaced apart from each other and defines a receiving channel. As shown in FIGS. 3 and 4, two recessed grooves 54 and a center connecting member 58 are defined within the upper handle 10 which correspond to and receive the lower handle fins 52 at the handle pivot point 18. These recessed grooves 54 and the center connecting member 58 allow rotational movement of the lower handle 12 within the grooves 54. The grooves 54, center connecting member 58 and fins 52 are suitably sized to minimize lateral movement of the lower handle 12 during the cutting operation. This configuration creates a balanced and durable connection between the lower handle 12 and the upper handle 10, enhancing the operation and life of the cutting tool. An upper handle cavity section 56 is defined forwardly of the handle grooves 54 as shown in FIGS. 4 and 5. The cavity section 56 is suitably sized to allow motion of the handle link section 48 and intermediary link 14 within the upper handle cavity section 56 during the cutting operation.

The lower handle 12 serves as a lever for inputting force into the tool whereby a user will place a palm on the top of the gripping section 28 of the upper handle 10, grasp the gripping section 46 of the lower handle 12 with the fingers, and squeeze the lower handle 12 to pull the lower handle 12 toward the upper handle 10. The gripping section 46 of the lower handle 12 may be contoured to minimize slippage from the user's fingers and may contain other ergonomic features for user comfort. The preferred embodiment of the invention contains a gripping section 46 that is coated with an elastomer which contains anti-slipping properties and which provides a cushion for user comfort. The gripping section 46 may also define a loop or arch similar to those found on the handles of scissors as described above.

As noted above, the intermediary link 14 is pivotally connected to the lower handle 12 at the first link pivot point 44 and pivotally connected to the lower jaw 16 at the second link pivot point 90. The pivot points 44 and 90 are located near the rounded distal ends 60 and 61 of the link 14, respectively. The interface between the link end 60 and the fins 52 is suitably sized to prevent lateral motion of the intermediary link 14 between the fins 52. This bridge type connection between intermediary link 14 and the lower handle 12 provides a balanced and strong connection to enhance durability of the cutting tool. Intermediary link 14 has an offset section 72 which connects with the lower jaw 16 through a hole 64 of the intermediary link and through a hole 66 of the lower jaw using a pin 62 at the second link pivot point 90.

Figure 6:
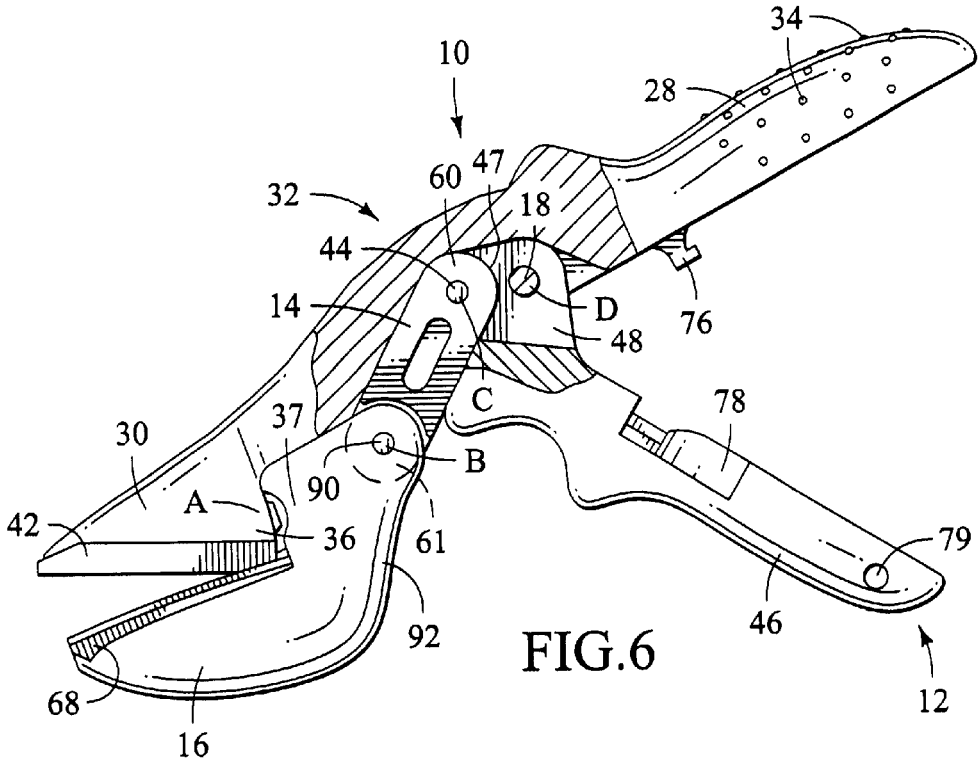
FIG. 6 is a partially cut-away side view of the cutting tool of the above Figures in the open position.

The lower jaw 16 is pivotally connected to the upper handle 10 at the jaw pivot point 36 and is also pivotally connected to the intermediary link 14 at the second link pivot point 90. The blade portion of the jaw 16 extends forwardly of the pivot point 36. The location of the jaw pivot point 36 at the lower jaw is in a forward direction with respect to the location of second link pivot point 90 at the lower jaw 16. As shown in FIG. 5 and FIG. 6, the pivot points 36 and 90 on the lower jaw 16 define a jaw link 37. The lower jaw 16 includes a blade 68 having a sharp edge 69 for cutting extending forwardly of the pivot point 36. The blade 68 can be defined or machined into the lower jaw 16, or the blade 68 can be a separate removable element to allow the user to conveniently replace the blade as necessary. The lower jaw 16 and upper handle 10 are pivotally connected such that the lower jaw 16 pivots toward the upper jaw section 30 in a scissor-like fashion, moving the blades 42, 68 of the upper jaw section 30 and lower jaw section 16 in proximity to each other, cutting the sheet metal in between the blades 42, 68.

FIGS. 5 and 6 show the cutting tool 2 in a closed state and an open state, respectively. In operation, as the lower handle 12 is pulled toward the upper handle 10 in FIG. 6, the handle link section 48 of the lower handle 12 preferably pivots around the handle pivot point 18 and the pivot point 44 moves in a downward direction relative to the upper handle 10. By this movement, the intermediary link 14 is thereby moved in a downward direction. This creates a toggling action as the first link pivot point 44 moves in a downward direction, the second link pivot point 90 moves in a direction away from the handle pivot point 18, and the handle pivot point 18, the first link pivot point 44, and second link pivot point 90 form a substantially straight line. As the handle pivot point 18, the first link pivot point 44, and second link pivot point 90 approach 180° toward the end of the cutting operation (where the jaws 30 and 16 are nearly completely closed) in FIG. 5, force is continually increased at the jaws 16 and 30, allowing for a substantial mechanical advantage throughout the entire cutting operation. As the second link pivot point 90 moves in a direction away from the handle cavity section 56, the intermediary link drives the rearward end 92 of the lower jaw 16 to move downwardly causing the lower jaw 16 to pivot clockwise as shown around the jaw pivot point 36. This pivoting action of the lower jaw 16 pushes the blade 68 of the lower jaw toward the blade 42 of the upper jaw in a scissor-like action, cutting material inserted between the jaws 30, 16.

FIG. 6 shows a partially cut-away side view of the cutting tool in the open position. The intermediary link 14 is substantially elevated toward the upper handle 10 and oriented within the cavity section 56. The handle pivot point 18, the first link pivot point 44 and the second link pivot point 90 form an angle in this position. When the cutting tool is in the open position, this angle can range from 0° to 145°. An example of the relative angles of the pivot points of the cutting tool 2 in the open position are shown in the schematic line diagram of FIG. 7. In this Figure, Point A represents the jaw pivot point 36, Point B represents the second link pivot point 90, Point C represents the first link pivot point 44, and Point D represents the handle pivot point 18. Line BC is of length Y, line CD is of length ($^{25}/_{64}$)Y, and line AB is of length ($^{27}/_{32}$)Y. In the open position, lines AB, BC and CD are preferably 29.52°, 69.78° and 4.28°, respectively, from horizontal. Preferably, angle ABC, as indicated by angle Θ, is 139.47°. Opposite angle ABC is angle BCD. Angle BCD, as indicated by angle α, is an obtuse angle at 114.5°. Although angle BCD is 114.5° in FIG. 7, angle BCD preferably can be between 0° and 145°.

When the cutting tool is in the closed position, as shown in FIG. 5, the intermediary link 14 has moved in a downward toggled direction into a position away from the upper handle 10. The handle pivot point 18, the first link pivot point 44 and the second link pivot point 90 form a substantially straight line. An example of the relative angles of the elements of the cutting tool 2 in the closed position are shown in the schematic line diagram of FIG. 8. Line BC is of length Y, line CD is of length $^{25}/_{64}$Y, and line AB is of length $^{27}/_{32}$Y. In the closed position, lines AB, BC and CD are preferably 10.00°, 63.87° and 59.28°, respectively, from horizontal. Preferably angle ABC, as indicated by angle Θ, is 126.13°. Angle BCD, as indicated by angle α, forms a substantially straight line at an angle of 175.41° when the tool is in the closed position. Although angle BCD is 175.41° in FIG. 8, angle BCD can be between 145° and 180°, but preferably not less than 170°.

Figure 7:
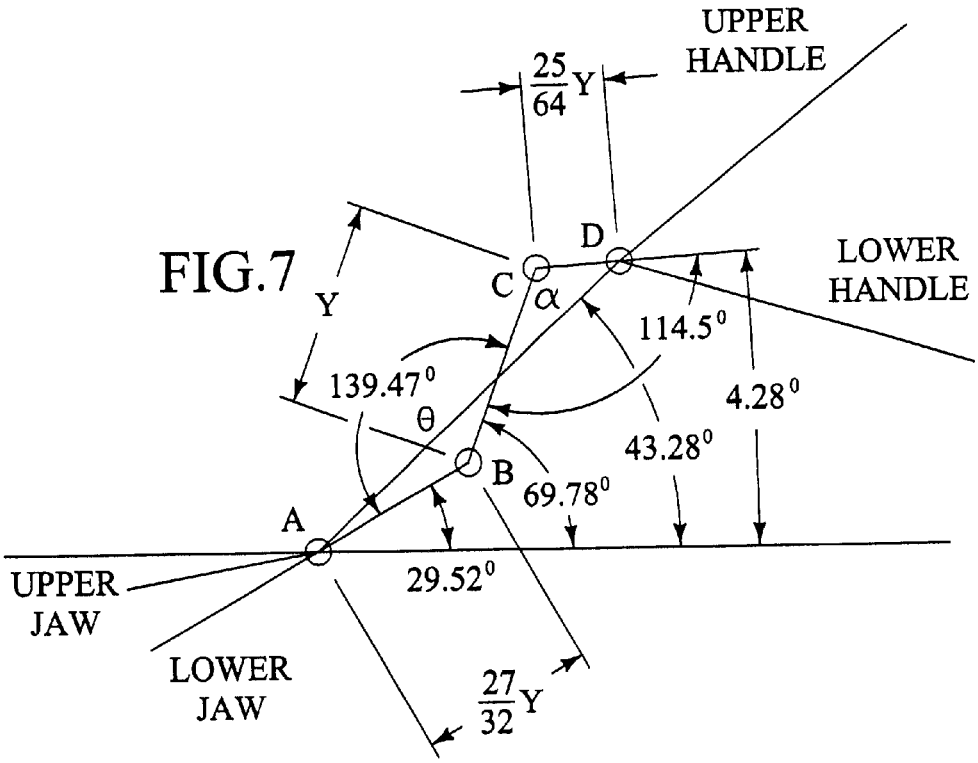
FIG. 7 is a schematic line diagram identifying angles between the linkages of an embodiment of the cutting tool of the present invention in the open position.
Figure 8:
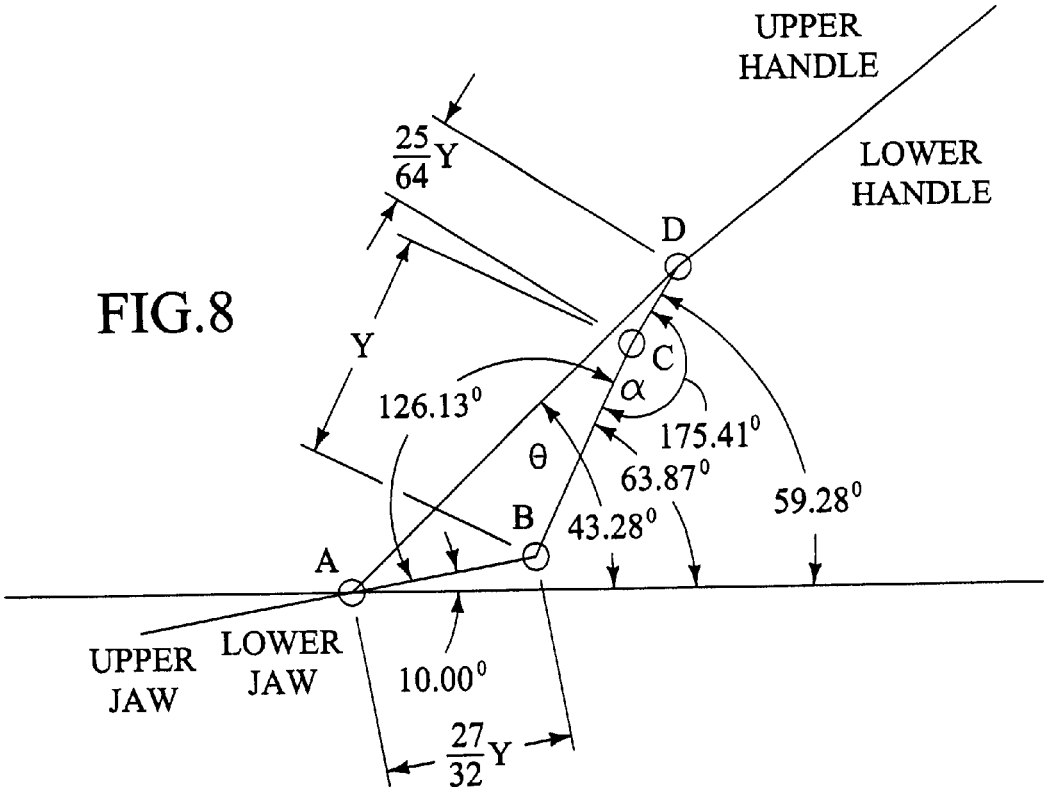
FIG. 8 is a schematic line diagram identifying angles between the linkages of an embodiment of the cutting tool of the present invention in the closed position.

While the relative measurements and angles are preferred and have been found to be optimal in the present embodiment, it is important to note that the angles and lengths shown in FIG. 7 and FIG. 8 are exemplary only. The invention is not limited in its construction and operation to the schematic line diagrams explained above. The invention is capable of other embodiments using different angles and lengths, which will provide the inventive function.

Due to the relatively high loads placed on the cutting tool during the cutting operation, the structural members of the invention should be made of a material, which is sufficiently rigid and strong to bear cutting loads for sheet material such as steel and aluminum. Tool steel or long glass filled nylon, preferably with a tensile strength of not less than 37 ksi should be utilized.

The preferred embodiment of the invention also includes curvilinear cutting blades 42 and 68 which aid in providing a mechanical advantage throughout the cutting operation. Both the upper jaw section blade 42 and the lower jaw blade 68 curve away from the material along the length of the blade. Preferably the upper jaw section blade 42 curves at a radius of 14 inches with an arc angle of 9.69°. The lower jaw blade 68 curves at a radius of 20 inches with an arc angle of 6.34°.

In the preferred embodiment, the gripping sections 28, 46 of the upper and lower handles are elevated with respect to the cutting blades so that when the upper jaw section cutting blade is substantially parallel with the cutting surface, the user's hand is elevated above the cutting surface, freeing the user's hand from the material being cut. This configuration allows for use of the cutting tool 2 in optimal cutting position while the user's hand remains free from the cutting surface. In the preferred embodiment, when the cutting blade 42 is substantially aligned with the horizontal plane as shown in FIG. 6, the angle of the upper handle 28 extends at approximately 43° thereto. As the lower handle 46 is brought together with the upper handle 28 as the jaws are closed, the lower handle 46 also extends at approximately this angle. It has been found that any angle of elevation ranging between 30° and 55° will provide similar advantages.

The preferred embodiment of the invention may also have a safety latch to prevent the lower jaw section from unintentionally opening when the tool is not in use. An embodiment of this safety latch is shown in FIG. 2 and comprises a flanged post 76 attached to the upper handle 10 extending toward the lower handle 12, and a slidable saddle 78 attached to the lower handle 12. When the handle is in the closed position, the saddle 78 may be slid to overlap the flange on the flanged post 76, thereby restricting downward motion of the handle and consequential movement of the lower jaw.

The invention may also define a hole 79 through the lower handle 12 through which a strap or loop may be placed for hanging the cutting tool from a work belt or tool rack.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A utility tool, said tool comprising:

an upper handle for holding the tool;

a jaw pivotally connected with the handle at a jaw pivot point and including a jaw link rigidly attached to said jaw;

means for inputting force connected with the upper handle and including a handle link rigidly attached to said means for inputting force;

a toggle action force transfer mechanism defined by an intermediary link extending between said jaw link and said handle link, wherein the jaw link and the intermediary link are pivotally attached at a link pivot point that is rearward of the jaw pivot point, and wherein force inputted to said means moves the intermediary link away from said upper handle when the jaw is moved from an open to a closed position.

2. The tool of claim 1 wherein the jaw and upper handle include blades for cutting material, said blades moving proximal to each other when force is inputted into the means for inputting force.

3. The tool of claim 2 wherein when the cutting blade of the upper handle is substantially aligned with the horizontal plane, the upper handle extends at an angle between 30° and 55° from the blade of the upper handle.

4. A cutting tool for cutting sheet material, said tool comprising:

an upper handle having an upper jaw section, a gripping section suitable for being grasped and an intermediary section connecting the upper jaw section with the gripping section, said upper jaw section having a blade portion and said upper jaw section being forward of said gripping section;

a lower handle having a gripping section wherein said lower handle is pivotally attached to the upper handle at a handle pivot point, wherein said lower handle may be pivoted toward the gripping section of the upper handle from an open position to a closed position, said lower handle also having a first link pivot point forward of the handle pivot point;

a lower jaw pivotally attached to the upper jaw section of the upper handle at a jaw pivot point, said lower jaw having a second link pivot point rearward of said jaw pivot point, and said lower jaw having a blade portion; and a link pivotally attached to the lower handle at the first link pivot point, and said link pivotally attached to the lower jaw at the second link pivot point such that pulling the lower handle toward the gripping section of the upper handle moves the link, said link then causing the blade portion of the lower jaw to pivot toward the blade portion of the upper handle, wherein the handle pivot point, the first link pivot point and the second link pivot point form a substantially straight line when the lower handle is in the closed position.

5. The cutting tool of claim 4 wherein the link moves in a direction away from the upper handle when the lower handle is moved from the open to the closed position.

6. The cutting tool of claim 4 wherein the handle pivot point, the first link pivot point and the second link pivot point form an angle of not less than 170° when the lower handle is in the closed position.

7. The cutting tool of claim 4 wherein the handle pivot point, the first link pivot point and the second link pivot point form between a 0° and 145° angle when the lower handle is in the open position and the handle pivot point, the first link pivot point and the second link pivot point form between a 145° and 180° angle, when the lower handle is in the closed position.

8. The cutting tool of claim 4 wherein said blade portion of the upper handle defines a curvilinear cutting edge.

9. The cutting tool of claim 4 wherein said blade portion of the lower jaw having a curvilinear cutting edge.

10. The cutting tool of claim 4 having a means for restricting movement of the lower handle from the closed position when the tool is not in use.

11. The cutting tool of claim 4 wherein when the cutting blade of the upper jaw section is substantially aligned with the horizontal plane and the cutting tool is in the closed position, the upper and lower handles extend at approximately at an angle between 30° and 55° from the upper jaw section.

12. The cutting tool of claim 4 wherein the gripping sections of the upper and lower handles are ergonomically shaped to fit a user's hand.

13. A method for cutting sheet material comprising the steps of:

providing a cutting tool with toggle link mechanism comprising an upper handle having an upper jaw section, a gripping section suitable for being grasped and an intermediary section connecting the upper jaw section with the gripping section, said upper jaw section having a blade portion and said upper jaw section being forward of said gripping section;

a lower handle having a gripping section wherein said lower handle is pivotally attached to the upper handle at a handle pivot point, wherein said lower handle may be pivoted toward the gripping section of the upper handle from an open position to a closed position, said lower handle also having a first link pivot point forward of the handle pivot point;

a lower jaw pivotally attached to the upper jaw section of the upper handle at a jaw pivot point, said lower jaw having a second link pivot point rearward of said jaw pivot point, and said lower jaw having a blade portion; and a link pivotally attached to the lower handle at the first link pivot point, and said link pivotally attached to the lower jaw at the second link pivot point such that pulling the lower handle toward the gripping section of the upper handle moves the link, said link then causing the blade portion of the lower jaw to pivot toward the blade portion of the upper handle, wherein the handle pivot point, the first link pivot point and the second link pivot point form a substantially straight line when the lower handle is in the closed position;

providing sheet material;

placing the sheet material in between the blades of the cutting tool when the cutting tool is in the open position;

applying force to the lower handle by pulling the lower handle toward the upper handle;

moving the link in a downward direction as the lower handle is pulled up so that the first link pivot point, the second link pivot point and the handle pivot point form a substantially straight line when the lower handle is in the closed position;

pivoting the lower jaw so that the lower blade moves toward the upper blade, cutting the sheet material.

* * * * *